US006464008B1

(12) United States Patent
Roddy et al.

(10) Patent No.: US 6,464,008 B1
(45) Date of Patent: Oct. 15, 2002

(54) WELL COMPLETION METHOD AND APPARATUS

(75) Inventors: Jim Roddy, Houston; Ray Vincent; Martin P. Coronado, both of Cypress; Rocky Turley, Houston, all of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/843,318

(22) Filed: Apr. 25, 2001

(51) Int. Cl.[7] ..... E21B 33/00
(52) U.S. Cl. ..... 166/285; 166/289; 166/154
(58) Field of Search ..... 166/285, 289, 166/290, 305.1, 153, 154, 184, 373

(56) References Cited

U.S. PATENT DOCUMENTS

| | | | | |
|---|---|---|---|---|
| 3,270,814 A | | 9/1966 | Richardson et al. | |
| 3,662,834 A | * | 5/1972 | Young | 166/314 |
| 3,768,562 A | | 10/1973 | Baker | |
| 3,882,935 A | * | 5/1975 | Calhoun | 166/224 |
| 3,948,322 A | * | 4/1976 | Baker | 166/289 |
| 4,105,069 A | | 8/1978 | Baker | |
| 4,484,632 A | * | 11/1984 | Vann | 166/297 |
| 4,602,684 A | | 7/1986 | Van Wormer et al. | |
| 5,020,597 A | * | 6/1991 | Braddick et al. | 166/291 |
| 5,024,273 A | | 6/1991 | Coone et al. | |
| 5,117,910 A | | 6/1992 | Brandell et al. | |
| 5,497,840 A | | 3/1996 | Hudson | |
| 5,598,890 A | | 2/1997 | Richard et al. | |
| 5,738,171 A | | 4/1998 | Szarka | |
| 5,746,274 A | | 5/1998 | Voll et al. | |
| 5,960,881 A | | 10/1999 | Allamon et al. | |
| 6,286,594 B1 | * | 9/2001 | French | 166/151 |

FOREIGN PATENT DOCUMENTS

WO WO 97/15748 5/1997

* cited by examiner

*Primary Examiner*—Frank Tsay
(74) *Attorney, Agent, or Firm*—Madan, Mossman & Sriram, P.C.

(57) ABSTRACT

An apparatus and method for the completion of wells through a production tube includes a tool body having cement flow ports and pressure displaced port closure elements. A perforated mandrel tube concentrically aligned within the production tube is secured to said tool body at its upper end. Concentrically within the mandrel tube is a dart transport tube. The dart transport tube is releasably secured to the tool body by a set of locking dogs. A first dart plug is placed in the production tubing bore at the well surface to be pumped or allowed to gravitate onto a closure seat in the lower end of the of the transport tube. This seat closure allows the production tubing to be pressurized for setting well annulus packers and opening of a cement port closure sleeve. After the production tube has been set by cement pumped down the production tubing bore and through the cement flow port, a second dart plug is positioned atop the cement column in the production tube. A pumped column of water or other well working fluid sweeps most of the production tube cement column into the well annulus and lower end of the transport tube. The second dart plug lands against an upper bore seat in the transport tube to enable another pressure increase in the production tube fluid column. This next pressure increase shifts a sleeve piston that closes the cement flow ports and releases the transport tube locking dogs. With the locking dogs released, the transport tube falls to the end of the perforated mandrel and opens the mandrel perforations to formation fluid flow from the screens into the production tube bore. Residual cement remaining in the tube bore is all displaced into the transport tube and removed from the production flow path without drilling.

15 Claims, 7 Drawing Sheets

WELL COMPLETION METHOD AND APPARATUS

BACKGROUND OF THE INVENTION

1. Field of the Invention

The present invention relates to deep well completion and production procedures and apparatus. More particularly, the invention relates to completion procedures and apparatus that avoid a final cement plug drilling procedure and a corresponding tool change trip.

2. Description of the Prior Art

The process and apparatus by which deep production wells for fluids such as oil and gas are completed and prepared for production involves the step of sealing the production zone or earth strata from contamination by foreign fluids from other strata, above or below. Additionally, the tubing through which the produced fluid flows to the surface must be secured and sealed within the well bore. Often, the production zones are thousands of feet below the earth's surface. Consequently, prior art procedures for accomplishing these steps are complex and often dangerous. Any procedural or equipment improvement that eliminates a downhole "trip" is a welcomed improvement.

Consistent with prior art practice, production tube setting and opening are separate "trip" events. First, the raw borehole wall casing is secured by placing cement in the annulus between the raw borehole wall and the outer surface of the casing pipe. A string of fluid production tubing is then positioned where desired within the borehole and the necessary annulus sealing packers are set by a controlled fluid pressure increase internally of the tubing bore, for example. After the packers are set, a cementing circulation valve in the production tube assembly is opened by another controlled change in the tubing bore pressure. Cement is then pumped into the segment of annulus around the production tubing that extends upwardly from the upper production zone packer.

This prior art procedure leaves a section of cement within the tubing below the cementing valve that blocks the upper tubing bore from production flow. The cement blockage is between the upper tubing bore and the production screen at or near the terminal end of the tubing string. Pursuant to prior art practice, the residual cement blockage is usually removed by drilling. A drill bit and supporting drill string must be lowered into the well, internally of the production tubing, on a costly, independent "trip" to cut away the blockage.

SUMMARY OF THE INVENTION

An objective of the present invention, therefore, is to position well production tubing within the wellbore, secure the tubing in the well by suitable means such as cement or epoxy, and open the tubing to production flow in one downhole trip.

Another objective of the invention is a completion assembly having the capacity for complete removal of the cement tubing plug without drilling.

It is also an object of the present invention to provide a more expeditious method of well completion by the elimination of at least one downhole trip.

In pursuit of these and other objectives to hereafter become apparent, the present invention includes a production tubing string having the present well completion tool body attached above the upper production packer and the production screen. The completion tool body includes upper and lower pipe subs that are linked by concentric radially spaced tubular walls. The tubular walls are perforated by flow trans for ports. With the annular space between the concentric walls are a pair of axially sliding sleeve pistons. Both sleeve pistons may be axially displaced by fluid pressure within a central flow bore of the tool to close flow continuity through the flow transfer ports between the central flow bore and the surrounding well annulus. An elongated mandrel tube is secured to the internal bore surface of the tool body at a point below the flow transfer ports. From the tool body attachment point, the mandrel tube extends downwardly and concentrically within the production tubing. A retainer socket terminates the lower end of the mandrel tube. The mandrel tube wall is perforated along the upper portion of its length above the plug seat.

Also secured within the internal bore surface of the tool body at a point above the flow transfer port is an elongated dart transport tube having a dart seat at each distal end. The dart transport tube extends longitudinally within the internal bore of the perforated mandrel and is releasably secured to the internal bore surface of the tool body by a set of locking dogs. Proximate of its upper end, the dart transport tube is perforated for flow continuity with the flow transfer ports in the tool body tubular walls.

The completion assembly is placed downhole with all tubes open. When in place, a first closing dart is dropped along the production string bore from the surface to be transferred by gravity and/or pumping onto the closure seat at the downhole end of the dart transport tube. Closure of the downhole seat permits the internal bore of the tubing string to be pressurized independently of the of the production zone wall.

The normal procedural sequence provides for a relatively low tubing string pressure to set the zone isolation packers. A second and greater fluid pressure within the production tubing opens the flow transfer ports in the tool body by shifting one of the closure sleeves. Cement is then delivered down the tubing bore under a pressure head sufficient to discharge the cement through the dart transport tube perforation and flow transfer ports in the tool body into the annulus between the tubing string and the casing wall.

When the appropriate quantity of cement has been delivered into the production tubing, a second closure dart is placed in the tubing bore to cap the surface of the cement column standing in the tubing bore. A finishing fluid such as water is pumped against the second dart thereby completing the flow displacement of the cement remaining in the production tube. When the second dart engages the upper seat of the dart transport tube, all cement is displaced into the well annulus except that remaining in the dart transport tube between the dart seats. Upon closure of the upper transport tube seat, internal tubing bore pressure may be increased to shift the second sleeve piston in the tool body that simultaneously closes the flow transfer ports and releases the locking dogs from the dart transport tube. When released, the dart transport tube travels down the perforated mandrel taking all of the residual cement with it.

At the end of the perforated mandrel is a retainer socket that receives and engages a nose dart on the dart transport tubing. This retainer socket secures the dart transport tube within and along a lower segment of the mandrel. Above the dart transport tube, the perforated mandrel is preferably pierced by numerous large apertures to accommodate a free flow of formation fluid into the internal bore of the production tube.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like elements throughout the several figures of the drawings and wherein.

DETAILED DESCRIPTION OF THE PREFERRED EMBODIMENTS

Figure 1:
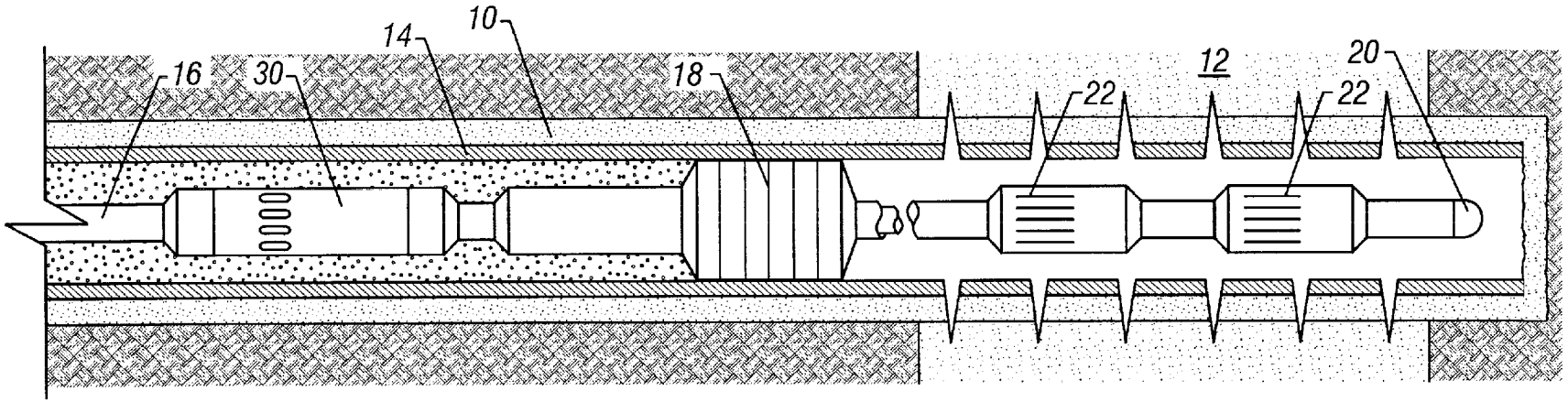
FIG. 1 is a schematic well having the present invention in place for completion and production.

The utility environment of this invention is typified by the schematic of FIG. 1, which illustrates a well bore 10 that is normally initiated from the earth's surface in a vertical direction. By means and procedures well known to the prior art, the vertical well bore may be continuously transitioned into a horizontal bore orientation as desired for bottom hole location or the configuration of a fluid production zone 12. Usually, a portion of the vertical, surface borehole 10 is internally lined by steel casing pipe 14, which is set into place by cement in the annulus between the borehole wall and outer surface of the casing 14.

Valuable fluids such as petroleum and natural gas held within the production zone 12 are efficiently conducted to the surface for transport and refining through a production tubing string 16. Herein the term "fluid" is given its broadest meaning to include liquids gases, mixtures and plastic flow solids. In many cases, the annulus between the outer surface of the production tube 16 and the inner surface of the casing 14 or raw well bore 10 will be blocked with some form of annulus barrier such as a production packer 18. The most frequent need for an annulus barrier such as a production packer 18 is to shield the lower production zone 12 from contamination by fluids drained along the borehole 10 from higher zones and strata.

The terminal end of a production string 16 may be an uncased open hole. However, the terminal end is also often equipped with a liner or casing shoe 20 and a production screen 22. In lieu of a screen, a length of drilled or slotted pipe may be used. The production screen 22 is effective to grossly separate particles of rock and earth from the desired fluids carried by the formation 12 structure and admits the production zone fluids into the inner bore of the tubing string 16. Accordingly, the term "screen" is used expansively herein as the point of well fluid entry into the production tube.

Pursuant to practice of the present invention, a production string 16 is provided with the present well completion tool assembly 30. The tool assembly is positioned in the uphole direction from the production screen 22 but usually in close proximity therewith. As represented by FIG. 1, the production packer 18, the completion tool assembly 30, the production screen 22 and the casing shoe 20 are preassembled with the production tube 16 as the production string is lowered into the wellbore 10.

Figure 2A:
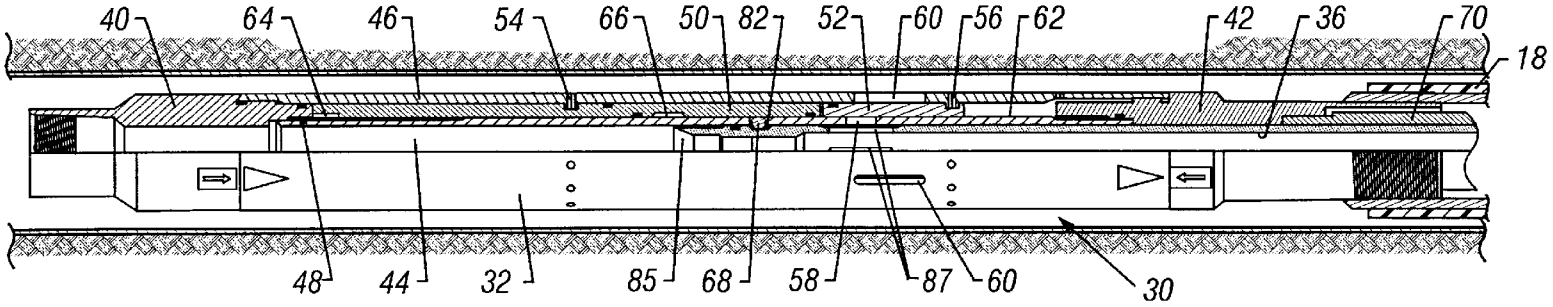
FIG. 2 A–C are an axial quarter section view of the invention as configured for initial downhole placement.
Figure 2B:
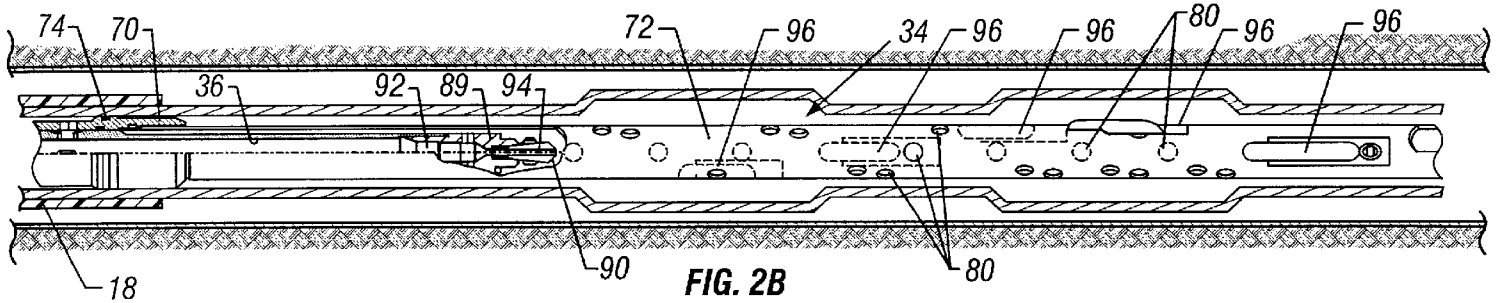
Figure 2C:
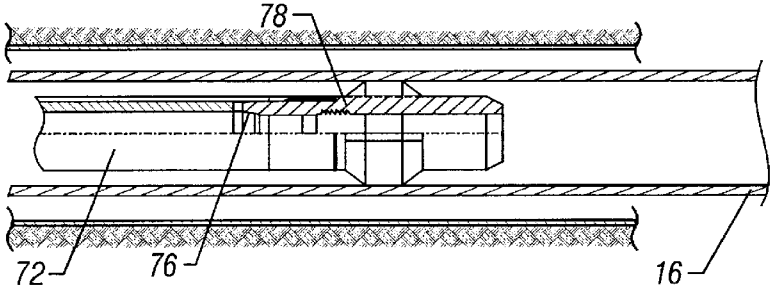

Referring to FIG. 2, the tool assembly comprises a tool body 32, a perforated mandrel 34 and a dart transport tube 36. The tool body 32 is terminated at opposite ends by a top sub 40 and a bottom sub 42, respectively. The subs 40 and 42 are joined by an internal sleeve 44 and an external sleeve 46. Between the sleeves 44 and 46 is an annular cylinder space. Axially slidable along the annular cylinder space are two annular pistons 50 and 52. The upper annular piston 50 is secured to the external sleeve 46 at an initial position by several shear pins 54. The lower annular piston is secured at an initial position by several shear pins 56.

The internal sleeve 44 is perforated by several cement flow transfer ports 58 distributed around the sleeve circumference. The external sleeve 46 is also perforated by several flow transfer ports 60 distributed around the sleeve circumference. The flow transfer ports 58 and 60 are aligned to facilitate fluid flow continuity through both ports from the interior bore of the internal sleeve 44 when the lower annular piston 52 is translated from an initial, flow blocking position as illustrated by FIG. 2, into the lower annular space 62. However, radial alignment of the flow transfer ports is not essential.

Figure 4A:
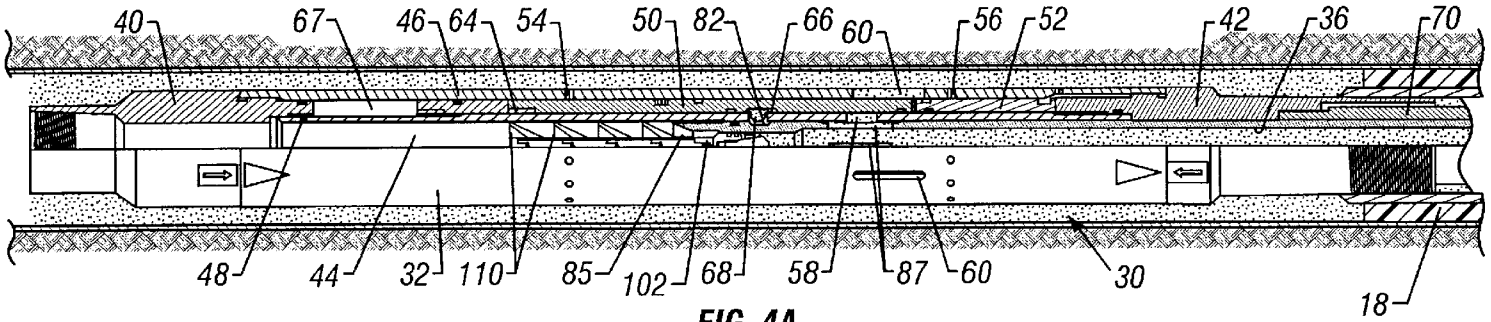
FIG. 4 A–C are an axial quarter section view of the invention as configured to purge the upper production tube bore of residual cement.

The inner sleeve 44 also includes several perforations 48 around the circumference thereof that provide fluid pressure communication between the internal bore of the tool body 32 and the upper piston pressure chamber 67. (See FIG. 4A) The inside surface of the upper piston 50 is circumferentially channeled as a relief detent 66 for radial locking dogs 68. The locking dogs 68 are carried by caging apertures in the internal sleeve 44.

The perforated mandrel 34 is a subassembly of a connecting sub 70 and a perforated flow tube 72. The connecting sub 70 threads internally to the lower tool body sub 42 and provides an internal assembly thread for the perforated flow tube. An annulus sealing device such as a sand barrier, plug or packer tube 18 assembles over the external threads of the lower sub 42. An O-ring ridge and seal 74 isolates an annular space between the outer surface of the perforated flow tube and the inner surface of the packer tube bore. At the end of the flow tube 72 is a dart plug retainer socket 76 around a bore end aperture 78. A plurality of production flow perforations 80 penetrate the flow tube 72 wall along an upper end length section.

The dart transport tube 36 slidably assembles coaxially within the internal bore of the internal sleeve 44 and extends coaxially into the internal bore of the mandrel flow tube 72. The transport tube is axially retained by the locking dogs 68 in meshed cooperation with a circumferential detent channel 82. The upper end of the transport tube form a dart plug seat 85. Below the dart plug seat are several fluid flow apertures 87 distributed around the transport tube circumference. The lower end of the transport tube is terminated by a finale 89 having a projecting dart plug 90 and an internal plug seat 92. An axial bore 94 extends through the finale 89 and plug 90.

Figure 6:
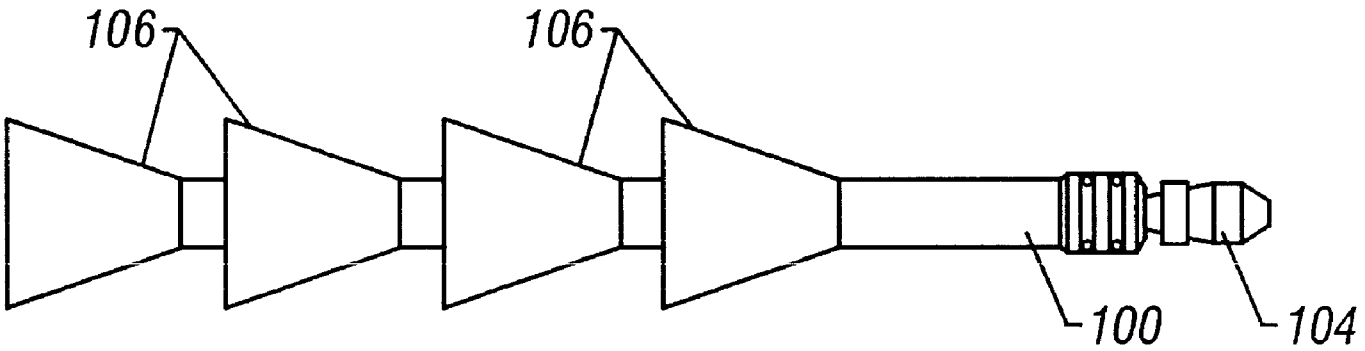
FIG. 6 is an axial section view of the first conduit closure dart.
Figure 7:
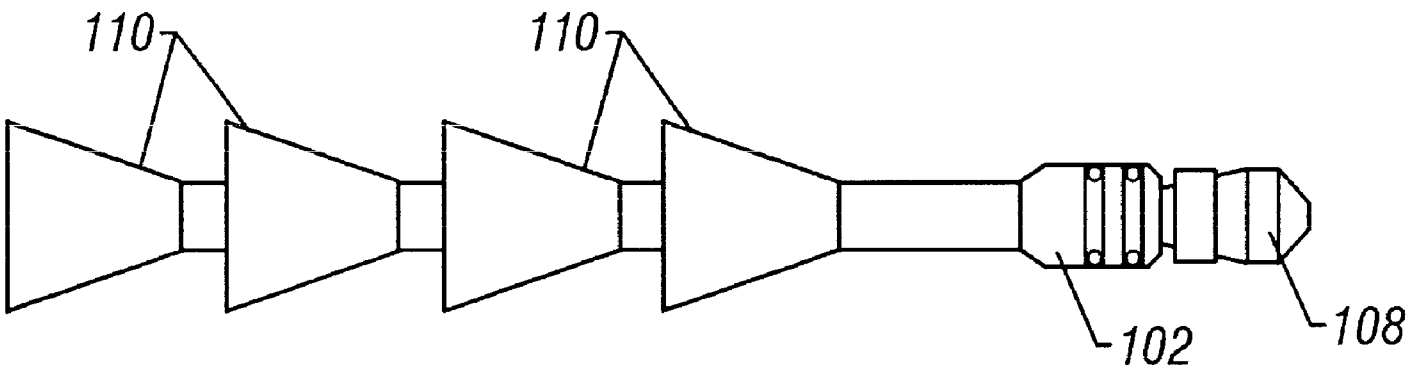
FIG. 7 is an axial section view of the second conduit closure dart.

The dart plugs 100 and 102 of FIGS. 6 and 7 are essentially the same except for size. The smaller dart plug 100 comprises a pintle nose 104 and several dart fins 106. The pintle nose 104 is sized and shaped to engage the transport tube seat 92 with a fluid seal fit. The fins 106 facilitate the pumped transfer of the dart along the length of a production string. The larger dart plug 102 has a pintle nose 108 that is appropriately sized to make a fluid tight seal with the upper transport tube seat 85. The nose of dart plug 90 at the terminal end of the transport tube 36 is sized to fit the retainer socket 76 at the terminal end of the perforated flow tube 72. A mechanical latching relationship between the retainer socket 78 and dart plug 90 secures the transport tube 36 at the lower end of the mandrel flow tube 72 once the dart plug 90 engages the socket 78.

For purposes of this preferred embodiment, the plugs 100 and 102 have been described as "darts". It should be understood, however, that the plugs may also be configured as balls, sponges or rods.

As an additional note to the perforated mandrel 34 design, the length of the mandrel flow tube 72 preferably includes a non-perforated section below the perforated section. The length of the non-perforated section of flow tube 72 generally corresponds to the length of the dart transport tube 36. An anti-reversing clip 96 is secured to the flow tube wall preferably at numerous point along the mandrel flow tube. Once the dart transport tube 36 has been translated to the lower end of the mandrel flow tube 72, the anti-reversing clips 96 will prevent a reverse translation of the transport tube 36 by engaging the trailing edges of the terminal fins 110.

The machine element alignments for running into a well are as illustrated by FIG. 2. Specifically, flow continuity between the cement flow transfer ports 58, 60 and 87 are aligned but closed between the ports 58 and 60 is interrupted by the annular piston 52. The closed position of the piston 52 is secured by the shear pin 56. The annular piston 50 is confined in the annular cylinder space above the lower piston 52 by the shear pin 54 and the end of the lower piston 52. In the upper position, the upper piston 50 confines the locking dogs 68 within respective caging apertures in the internal sleeve 44 to penetrate the detent channel 82 in the dart transport tube 36. Consequently, the transport tube 36 is secured at the required axial position. There are no plugs in the bore so there is a free transfer of well fluids along the tubing bore.

Figure 3A:
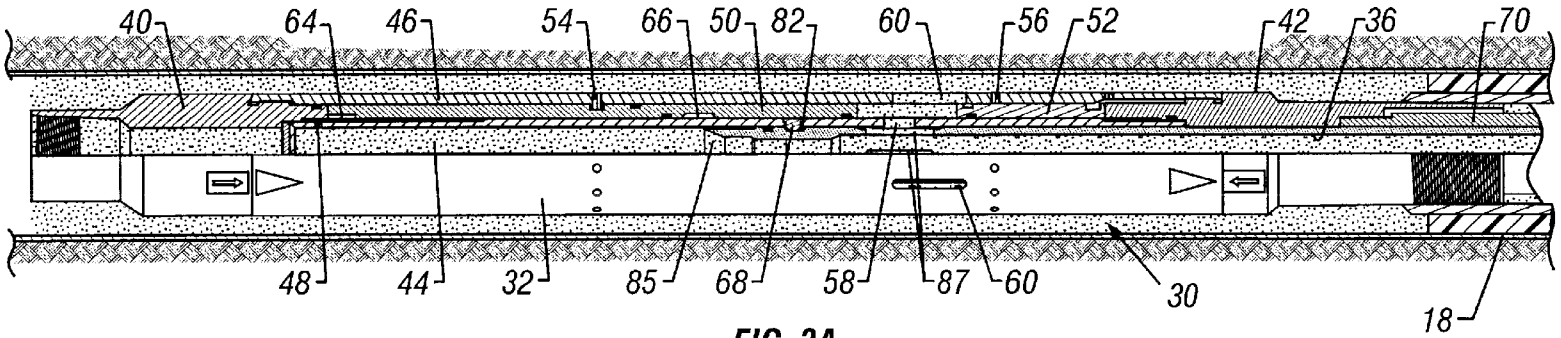
FIG. 3 A–C are an axial quarter section view of the invention as configured for cement displacement into the well bore.
Figure 3B:
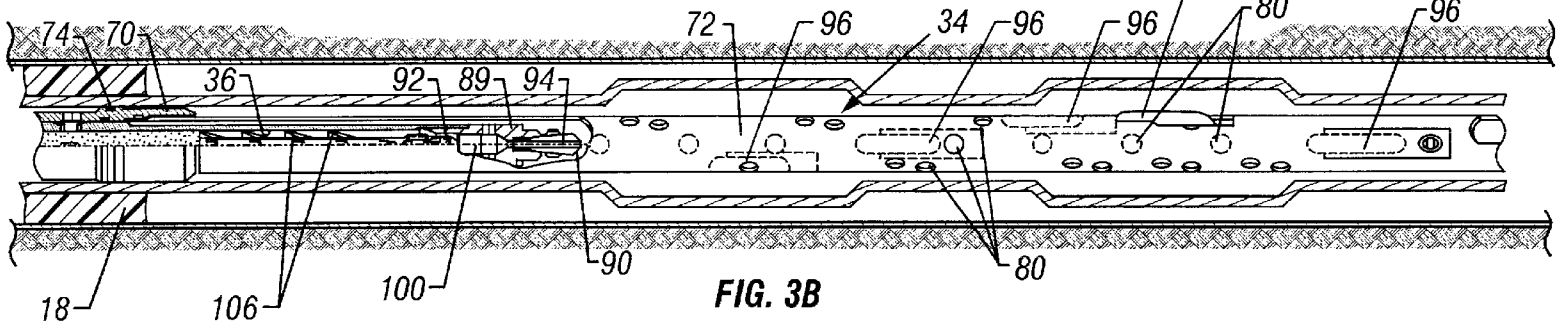
Figure 3C:
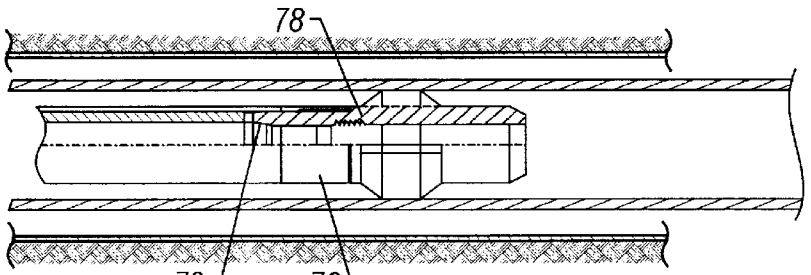

With respect to FIG. 3, the completion string assembly is positioned along the borehole length at the desired set position. At this point, the dart plug 100 is placed in the production tubing bore at the well surface and either pumped or permitted to gravitate down onto the transport tube bore seat 92 to close the flow bore 94. With the flow bore 94 closed, the fluid pressure within the tubing string bore may be increased by surface pumps (Not Shown) to set the packer 18 against the well wall, whether cased or raw borehole.

With the packer 18 set, the tubing bore pressure is further increased to bear against the upper end of the annular piston 52. When sufficient, the pressure load on the piston 52 shears the retainer pins 56 and drives the piston 52 down into the annular cylinder space 62 and away from the openings of flow transfer ports 58 and 60. Well completion cement may now be pumped along the bore of tubing 16 into the production tube annulus. Due to the presence of the packer 18, downflow of the cement between the screens 22 and the production zone face is prevented. The cement is forced to flow upward from outer flow ports 60 around the production tube.

Figure 4B:
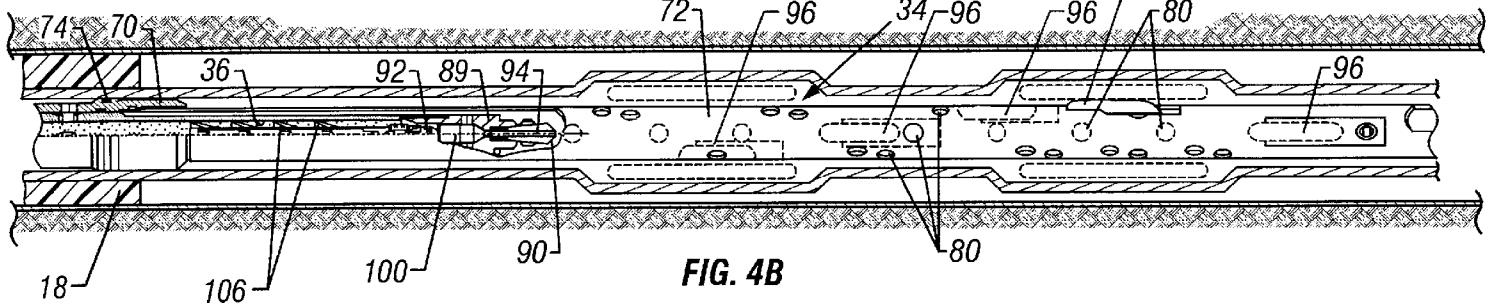
Figure 4C:
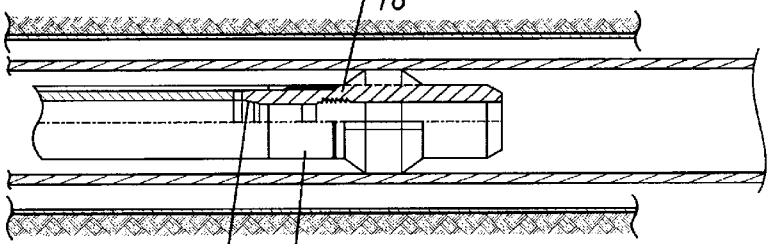

When the predetermined quantity of cement has been placed in the production tube bore, the tail end of the cement column is capped by the larger dart plug 102. Another well working fluid such as water is then pumped against the dart fins 110 thereby driving the column of cement in the production tube bore out through the flow ports 58, 60 and 87. Cement displacement by the dart plug 102 ends when the dart plug engages the transport tube upper seat 85 as illustrated by FIG. 4. The only residual cement remaining within the production tube is that filling the transport tube 36 between the seats 85 and 92.

With the dart plug 102 set against the transport tube seat 85, tubing borehole pressure may again be increased. Such increased pressure bears now against the upper end of the upper piston 50 through the pressure ports 48. When the resultant force on the piston end face is sufficient, the retainer pins 54 will fail thereby permitting the upper piston to translate down the annular space against the end face of the lower piston 52 to obstruct the cement flow path between ports 58 and 60. Simultaneously, the down position of the upper piston 50 aligns the detent channel 66 with the locking dogs 68 thereby permitting the dogs to translate radially out of interfering engagement with the detent channel 82 in the dart transport tube 36.

A body lock ring 64 that is secured to the upper end of the upper piston 50 engages strategically positioned circumferential threads or serrations on the outer perimeter of the internal sleeve 44 to secure the displaced position of the piston 50 and the closure of flow continuity between flow transfer ports 58 and 60.

Figure 5A:
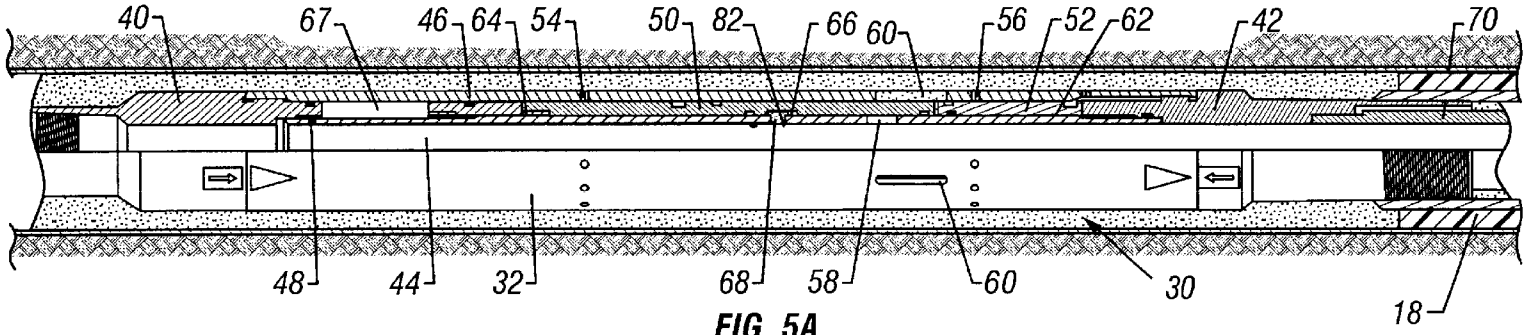
FIG. 5 A–C are an axial quarter section of the invention as configured for formation fluid production.
Figure 5B:
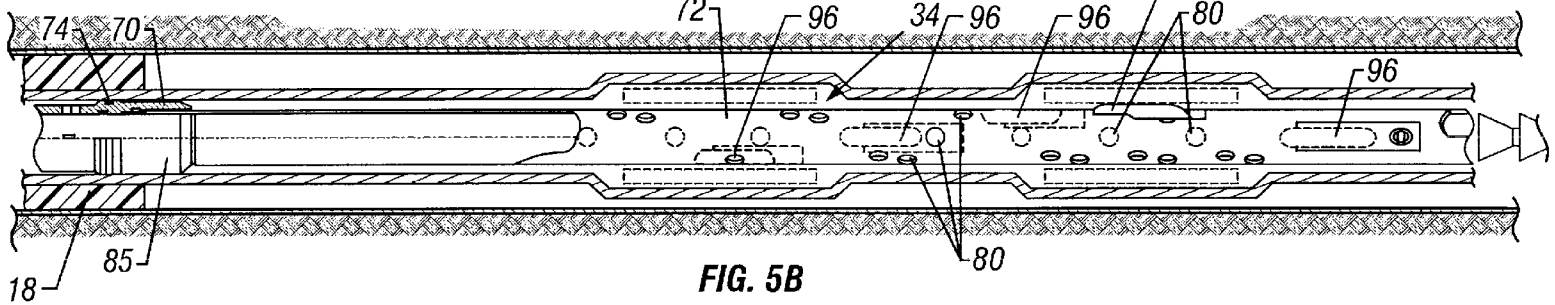
Figure 5C:
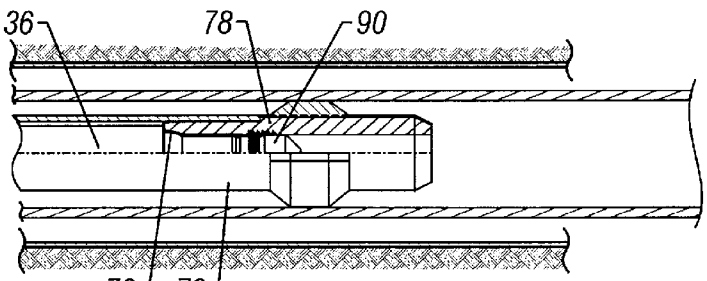

Upon withdrawal of the locking dogs 68, the dart transport tube is free to translate down the length of the perforated mandrel 34 to latch the dart 90 into the retainer socket 76 as illustrated by FIGS. 4 and 5. This shift opens a formation fluid flow channel from the screens 22, along an annulus between the screen tubing bore and the perforated mandrel 34, through the mandrel perforations 80 and into the internal flow bore of the tool body internal sleeve 44.

Figure 8:
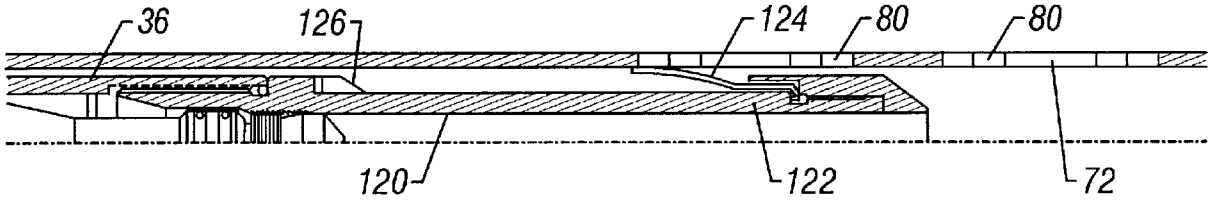
FIG. 8 is an axial quarter section view of an alternative transport tube end dart within the perforated section of the perforated mandrel.
Figure 9:
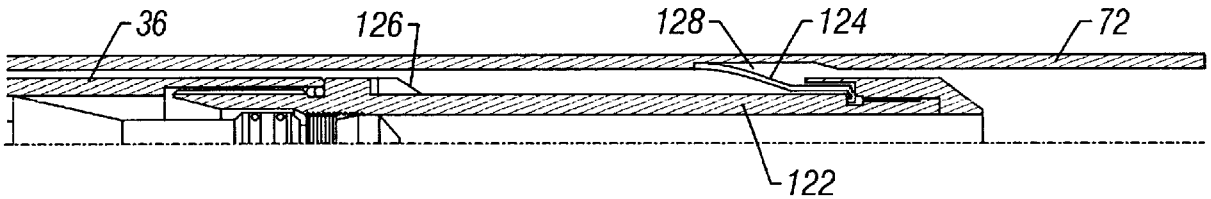
FIG. 9 is an axial quarter section view of the alternative transport tube end dart with the rectifying barb engaged with an internal ledge.
Figure 10:
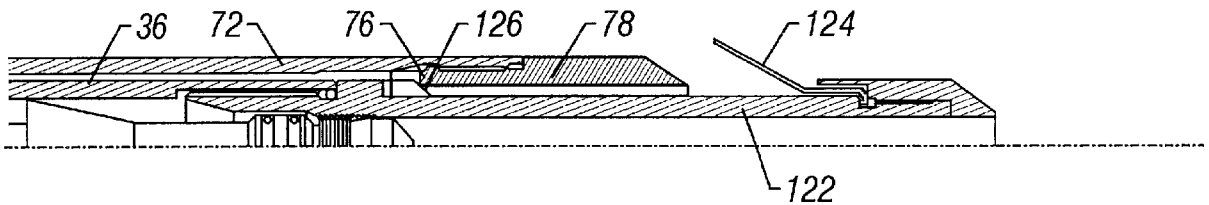
FIG. 10 is an axial quarter section view of the alternative transport tube end dart projecting from the end of the perforated mandrel.

FIGS. 8, 9 and 10 illustrate an alternative design embodiment for securing the transport tube 36 to the distal end of the perforated mandrel. Primarily, the alternative dart plug 120 comprises a projecting stinger 122 having several radially projecting spring barbs 124. As shown by FIG. 8, the barb 124 flexes away from the inside bore wall of the perforated mandrel flow tube 72 as it passes through the section of perforations 80. Below the perforations 80 but above the distal end of the mandrel flow tube 72, one or more sharp bottom grooves 128 may be cut into the inside wall of the flow tube as shown by FIG. 9, to latch the barbs intermediate of the flow tube end. FIG. 10 illustrates the stinger 122 projecting from the end of the mandrel flow tube 72 and the dart shoulder 126 effectively engaging the shoulder 76.

The foregoing preferred embodiment of the invention has been described in relation to a previously cased and perforated well bore. It should be understood, however, that the invention is equally applicable to an uncased borehole. It should also be understood that "production tubing", "tubing string", "production string", "production casing", etc. are all equivalent terms in the lexicon of the art.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A well completion tool for disposition in a production tubing string, said tool comprising:

(a) A substantially cylindrical tool body having a central flow bore therethrough and a flow transfer port between the tool body bore and external surroundings of said tool body;

(b) A flow transfer port closure element within said tool body that is selectively opened by fluid pressure within said flow bore;

(c) A tubular mandrel secured to said tool body and projecting axially therefrom, said mandrel having a mandrel wall around an internal mandrel bore, and mandrel wall perforations between said tool body and a lower end of said mandrel bore;

(d) A plug transport tube releasably secured to said tool body and projecting axially from said tool body within said mandrel bore, said transport tube having a tube wall around an internal tube bore, flow transfer ports through the transport tube wall and a tube bore closure seat distal from said flow transfer ports; and, (e) A transport tube release element within said tool body that is selectively displaced by fluid pressure within the tool body flow bore to release said transport tube from said tool body for translation along said mandrel whereby a flow channel from said mandrel wall perforations into said tool body flow bore is opened.

2. A well completion tool as described by claim 1 wherein said transport tube release element is also a flow transfer port closure element.

3. A well completion tool as described by claim 1 wherein said flow transfer port closure element comprises first and second flow transfer closure elements whereby said flow transfer ports are initially closed by said first closure element and selectively opened by displacement of said first closure element.

4. A well completion tool as described by claim 3 wherein said second flow transfer closure element is subsequently and selectively displaced to close said flow transfer ports.

5. A well completion tool as described by claim 1 wherein the lower end of said mandrel bore includes a retainer mechanism to secure said transport tube at a displaced position along said mandrel bore after release from said tool body.

6. A well completion tool as described by claim 5 wherein said transport tube includes a latch plug element for engaging said mandrel bore retainer mechanism.

7. A well completion tool as described by claim 1 wherein said mandrel wall perforations extend along a first length of said mandrel wall from said tool body to a second length of said mandrel wall between said perforations and said mandrel bore lower end.

8. A well completion tool as described by claim 7 wherein said second length of mandrel wall substantially corresponds with the length of said transport tube.

9. A method of producing a well comprising the steps of:

(a) positioning well fluid production tubing within a well borehole in flow communication with a well production zone;

(b) cementing said production tubing within said well borehole above said well production zone;

(c) confining substantially all residual cement remaining in said production tubing within the bore of an axially transported tube; and, (d) opening the internal bore of said production tubing to fluid flow from said production zone by moving said axially transported tube within said production tubing from a flow obstructing position.

10. A method of producing a well as described by claim 9 wherein an annulus barrier is erected in said borehole around said production tubing and above said well production zone.

11. A method of completing a fluid producing well comprising the steps of:

(a) Providing a tubing string tool having a cement flow port selectively opened by fluid pressure within a fluid flow bore in said tool, a perforated tube extending below said cement flow port and a tubular plug releasably secured to said tool and positioned to extend past said cement flow port into said perforated tube;

(b) providing a perforated tube within said fluid flow bore extending below said cement flow port;

(c) releasably securing a transfer tube within said fluid flow bore, said transfer tube positioned to extend past said cement flow port into said perforated tube, said transfer tube having a fluid flow channel therein that is open to said fluid flow bore and to said cement flow port;

(d) plugging a lower end of a fluid flow bore within said transfer tube to facilitate a first fluid pressure increase within said tubing string;

(e) opening-said cement flow port by said first fluid pressure increase;

(f) pumping cement through said open cement flow port;

(g) capping a cement column in said tubing with a transport plug;

(h) pumping fluid against said transport plug for moving said transport plug against a sealing seat in said transfer tube fluid flow channel, such transport plug movement driving the displacement of said cement column through said cement flow port into a well annulus around said tool;

(i) closing said cement flow port by a fluid pressure increase in said production tubing bore;

(j) releasing said transfer tube from said tool by a fluid pressure increase in said production tubing bore; and, (k) transporting said transfer tube along said perforated tube substantially past tube wall perforations therein to admit formation fluid flow through said perforations into said production tube bore.

12. A method of completing a fluid producing well as described by claim 11 wherein a well annulus barrier is erected by said first fluid pressure increase, said cement flow port being opened by a second fluid pressure increase.

13. A method of completing a fluid producing well comprising the steps of:

(a) positioning well fluid production tubing in said well, said production tubing having a well annulus barrier and a selectively opened and closed first flow port between a main flow channel in said tubing and a well annulus around said tubing;

(b) providing a perforated tube within said main flow channel below said first flow port, said perforated tube having a first tube bore;

(c) providing a transport tube within said main flow channel extending from above said first flow port into said first tube bore, said transport tube having a second tube bore, a tube wall perforation between said second tube bore and said first flow port, said transport tube further having a releasable attachment to said tubing;

(d) depositing a first plug in said main flow channel to close said second tube bore and enable a first pressurization of said main flow channel for engagement of said well annulus barrier;

(e) providing a second pressurization of said main flow channel to open said first flow port;

(f) deposition a second plug in said main flow channel to close said second tube bore above said first flow port;

(g) providing a third pressurization of said main flow channel to close said first flow port and release said attachment to said tubing; and (h) displacing said transport tube along said perforated tube to open a production flow channel from below and said annulus barrier into said main flow channel.

14. A method as described by claim 13 wherein cement is pumped through said open first flow port into said well annulus around said tubing.

15. A method as described by claim 14 wherein residual cement remaining within said second tube bore in the proximity of said first flow port is displaced from said first flow port along said first tube bore.

* * * * *